US011125013B1

(12) United States Patent
Taylor, III

(10) Patent No.: US 11,125,013 B1
(45) Date of Patent: Sep. 21, 2021

(54) SCREEN ENCLOSURE FRAME

(71) Applicant: James Blanford Taylor, III, Bonita Springs, FL (US)

(72) Inventor: James Blanford Taylor, III, Bonita Springs, FL (US)

( * ) Notice: Subject to any disclaimer, the term of this patent is extended or adjusted under 35 U.S.C. 154(b) by 0 days.

(21) Appl. No.: 17/100,065

(22) Filed: Nov. 20, 2020

Related U.S. Application Data

(63) Continuation-in-part of application No. 29/755,942, filed on Oct. 23, 2020.

(51) Int. Cl.
*E06B 9/52* (2006.01)

(52) U.S. Cl.
CPC ..... *E06B 9/52* (2013.01); *E06B 2009/527* (2013.01)

(58) Field of Classification Search
CPC ..... E06B 9/52; E06B 2009/527; E06B 1/04; E06B 3/22; E04C 2003/0465
USPC ..... 52/656.7, 653.1, 653.2, 762, 764, 772, 52/775, 780, 781
See application file for complete search history.

(56) References Cited

U.S. PATENT DOCUMENTS 2,180,415 A 11/1939 Herrmann
3,295,283 A * 1/1967 Griffith ..... E04B 2/7809 52/481.1
3,489,199 A * 1/1970 Weikel ..... E06B 9/52 160/90
4,084,360 A 4/1978 Reckson
5,046,546 A * 9/1991 Benedyk ..... E06B 9/521 160/371
6,092,348 A * 7/2000 Dombchik ..... E04C 3/06 52/653.1
6,192,643 B1 * 2/2001 Zadok ..... E04B 1/0046 52/204.1
6,945,305 B1 * 9/2005 Limauro ..... E06B 9/52 160/369
7,222,467 B2 5/2007 Nowell et al.
7,526,902 B2 * 5/2009 Green ..... E06B 3/285 52/204.5
7,861,473 B1 1/2011 Green
9,534,417 B2 * 1/2017 Green ..... E04H 17/08
D813,418 S 3/2018 Ewoldt
2005/0235585 A1 * 10/2005 Green ..... E06B 3/285 52/204.5

(Continued)

FOREIGN PATENT DOCUMENTS

DE 3708640 A1 10/1988
EP 1726745 A1 * 11/2006 ..... E04B 1/0046

*Primary Examiner* — Brent W Herring
(74) *Attorney, Agent, or Firm* — George F. Wallace

(57) ABSTRACT

A screen enclosure frame can include a post rail having a post rail body with front, rear, right, and left sides defining a post rail cavity, a first flange extending from and perpendicularly to the right side and having a first spline groove, a second flange extending from and perpendicularly to the left side and having a second spline groove. Optionally, a frame can further include a rear bracket for securing the post rail to a floor, and optionally, can further include at least one side bracket for further securing the post rail to a floor. Also optionally, a frame can further include a track rail having a track rail body with proximate, distal, and upper sides, an upper flange extending perpendicularly from the upper side and having an upper spline groove, and a lower flange extending perpendicularly from the upper side. The upper and lower flanges can be coplanar.

18 Claims, 7 Drawing Sheets

(56) References Cited

U.S. PATENT DOCUMENTS

2008/0289278 A1* 11/2008 Green ..... E06B 3/285
52/474

* cited by examiner

FIG. 9A
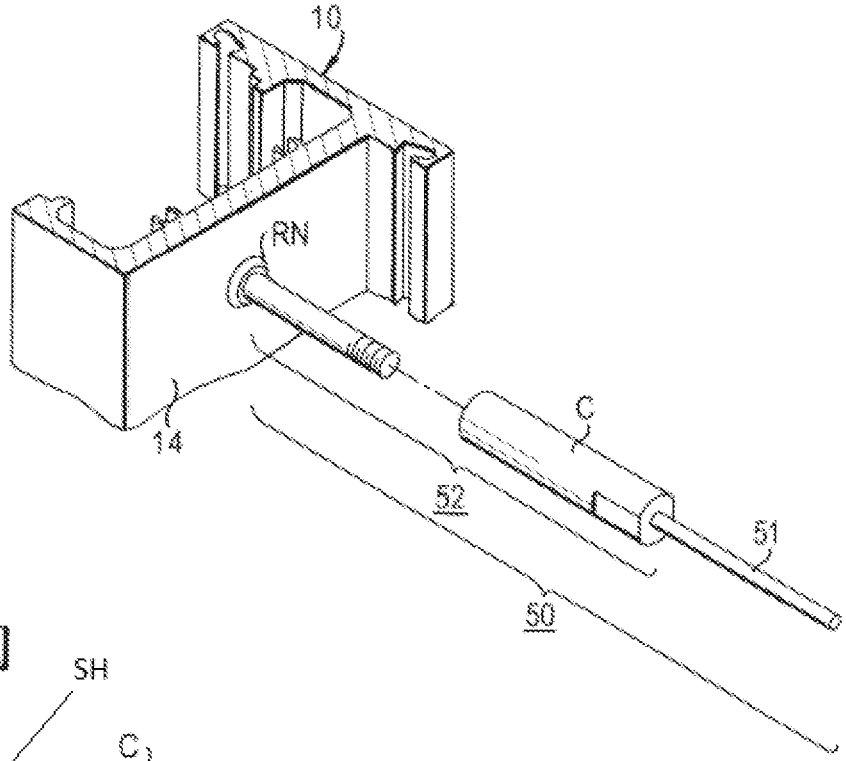
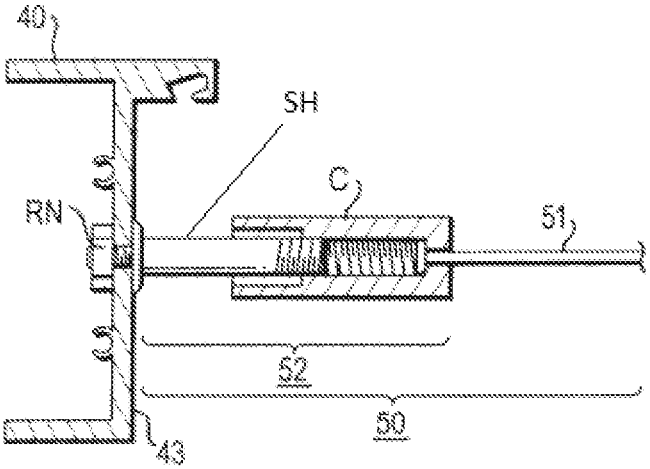
FIG. 9B
FIG. 10
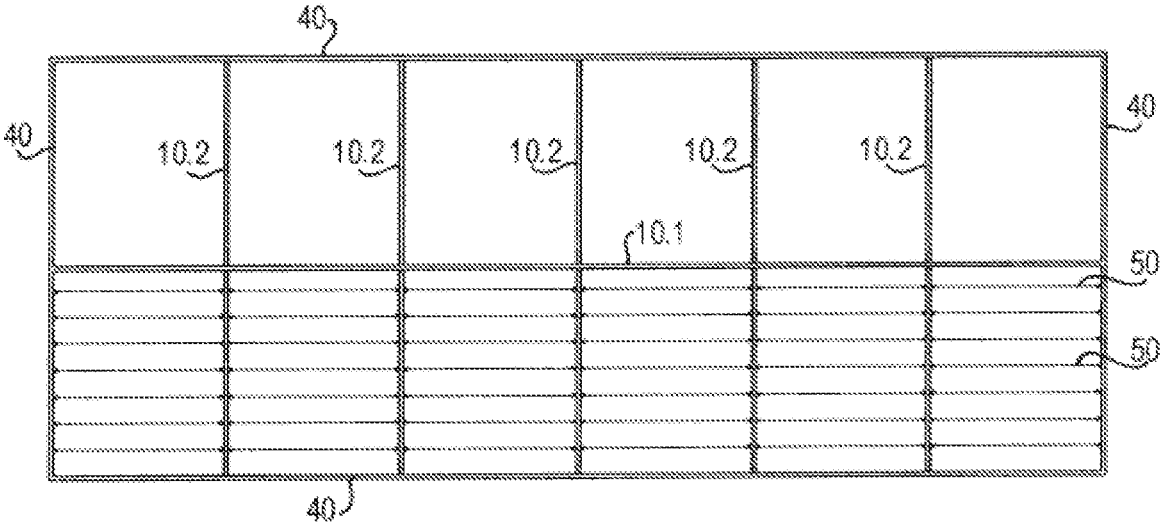

SCREEN ENCLOSURE FRAME

RELATED DOCUMENTS

This application is related to, incorporates by reference in its entirety, and claims the priority benefit of co-pending U.S. Design Patent Application Ser. No. 29/755,942 filed on Oct. 23, 2020 by James Blanford Taylor, III.

FIELD OF THE INVENTION

The present invention relates to screen enclosures, and more particularly, to screen enclosure frames.

BACKGROUND OF THE INVENTION

Screen enclosure frames are used to enclose exterior concavities of a structure, such as a dwelling or office building. Common concavities include a porch or lanai. Such frames allow the attachment of spans of screen, so as to provide a screened area, which can prevent debris or insects from entering therein.

SUMMARY OF THE INVENTION

The present invention provides a screen enclosure frame.

An exemplary environment of the present invention can include an exterior area of structure, which can include a floor and a structural frame, which can be defined by one or more walls, pillars, etc.

According to one exemplary embodiment of the present invention, a screen enclosure frame can include a novel post rail, comprising a post rail body, and first and second flanges.

In exemplary aspects of the present invention, a post rail body can have a parallelepiped shape; a post rail body can include front, rear, right, and left sides defining a post rail cavity therebetween; a first flange can be connected to the post rail body, and can extend from, and perpendicularly to, the right side; a first flange can include a first spline groove; a second flange can be connected to the post rail body, and can extend from, and perpendicularly to, the left side; the second flange can have a second spline groove; and the first and second flanges can be coplanar.

In another exemplary aspect of the present invention, a first flange can include an outer first flange surface, the rear side can include an outer rear side surface facing away from the front side, and the outer first flange surface and the outer rear side surface can form a continuous surface.

In additional exemplary aspects, a first and/or a second flange can respectively include inner surfaces that is a respective spline groove.

In another exemplary aspect, one of the right and left sides can fixably attach to the post rail.

In yet another exemplary aspect, one of the right and left sides can include an inner surface having at least one screw boss.

In still another exemplary aspect, at least one of the first and second flanges can be integral with the rear side.

In another exemplary embodiment of the present invention, a screen enclosure frame can further include a novel a rear bracket having a rail brace configured to abut and attach to the rear side, a floor brace configured to abut a floor upper surface, and a side brace configured to abut and attach to a floor side.

In a further exemplary embodiment of the present invention, a screen enclosure frame can further include a side bracket comprising a lateral brace configured to abut and attach to one of the right and left sides, and a surface brace configured to abut and attach to the floor upper surface.

In another exemplary embodiment of the present invention, a screen enclosure frame can further include a track rail comprising a track rail body having proximate, distal, and upper sides; an upper flange, connected to the track rail body, and extending perpendicularly from the upper side, the upper flange having an upper spline groove; and a lower flange, connected to the track rail body, and extending perpendicularly from the upper side; with the upper and lower flanges being coplanar.

In an exemplary aspect, an upper flange can include an outer upper flange surface, a distal side can include an outer distal side surface facing away from the proximate side, and the outer upper flange surface and the outer distal side surface can form a continuous surface.

In another exemplary aspect, an upper flange can include an inner upper flange surface that can include the upper spline groove.

In still another exemplary aspect, an upper flange can includes an outer upper flange surface, the lower flange can include an outer lower flange surface, the distal side can include an outer distal side surface facing away from the proximate side, and the outer upper flange surface, the outer lower flange surface, and the outer distal side surface can form a continuous surface.

In an additional exemplary aspect, upper and lower flanges can be integral with a distal side.

BRIEF DESCRIPTION OF THE DRAWINGS

FIG. 9A illustrates a perspective view of an exemplary post rail having a spindle assembly attached thereto.

FIG. 9B illustrates a side view perspective of an exemplary track rail having a spindle assembly attached thereto.

FIG. 10 illustrates plural exemplary post rails, track rails, and spindle assemblies configured to form an exemplary screen enclosure frame.

DETAILED DESCRIPTION

It is an object of the present invention to provide a screen enclosure frame having functional utility.

It should be noted that this disclosure includes a plurality of embodiments each having a plurality of elements and/or aspects, and such elements and/or aspects need not necessarily be interpreted as being conjunctively required by one or more embodiments of the present invention. In particular, all combinations of elements and/or aspects can enable a separate embodiment of the present invention, which may be claimed with particularity in this or any future filed Patent Applications. Moreover, such elements and/or aspects disclosed herein, whether expressly or implicitly, are to be construed strictly as illustrative and enabling, and not necessarily limiting. Therefore, it is expressly set forth that any elements and/or aspects, independently or in any combination of one of more thereof, are merely illustratively representative of one or more embodiments of the present invention and are not to be construed as necessary in a strict sense.

Further, to the extent the same element and/or aspect is defined differently anywhere within this disclosure, whether expressly or implicitly, the broader definition is to take absolute precedence, with the distinctions encompassed by the narrower definition to be strictly construed as optional.

Illustratively, perceived benefits of the present invention can include functional utility, whether expressly or implicitly stated herein, or apparent herefrom. However, it is expressly set forth that these benefits are not intended as exclusive. Therefore, any explicit, implicit, or apparent benefit from the disclosure herein is expressly deemed as applicable to the present invention.

An exemplary environment of the present invention can include an exterior area of structure, which can include a floor and a structural frame having one or more walls, pillars, etc.

According to the present invention, a screen enclosure frame can be formed from any one or more materials or combinations of materials, such as one or more of plastic, rubber, wood, metal, a crystalline material, or any other man-made or naturally occurring material, for example and not in limitation, insofar as functionally consistent with the invention as described. Further, such a system can be manufactured in any one or more functionally compatible manners, such as through molding, cutting, machining, etc. For example and not in limitation, one or more components of such a frame can be formed from extruded aluminum, which can optionally be cut and/or bent insofar as desired. Moreover, any element of a screen enclosure frame can be attached to another, or to a floor or structural frame, with any known or functionally compatible attachment element, such as a screw, bolt, magnet, adhesive, clamp, for example and not in limitation.

Figure 1A:
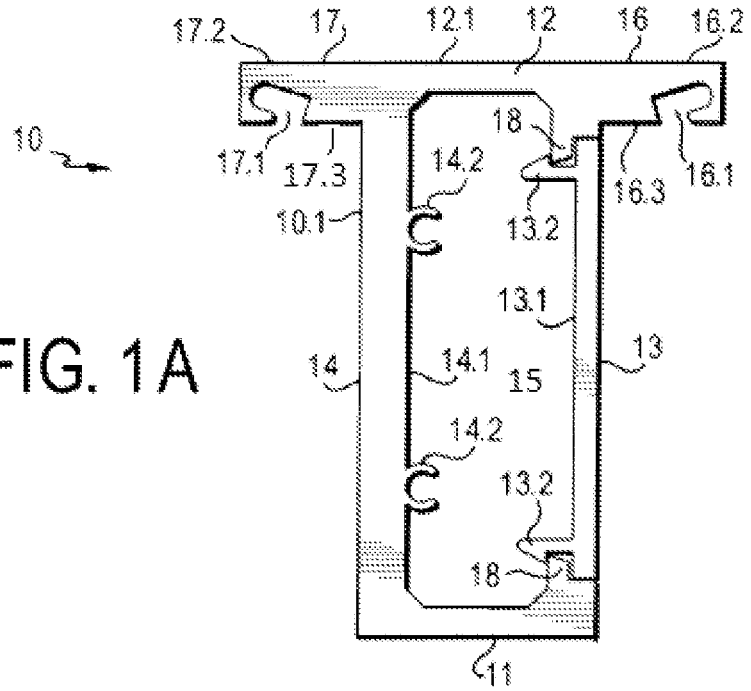
FIG. 1A illustrates a top view an exemplary post rail having first and second flanges having respective spline grooves.
Figure 1B:
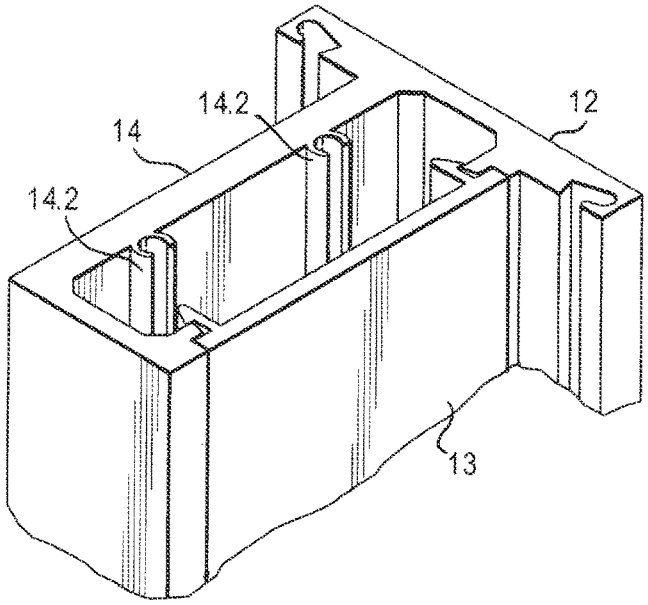
FIG. 1B illustrates a perspective view of an exemplary post rail.

FIGS. 1A and 1B illustrate an exemplary post rail 10 that can include a post rail body 10.1, a first flange 16, and a second flange 17.

As illustrated in FIG. 1A, post rail body 10.1 can include front 11, rear 12, right 13, and left sides 14 defining a post rail cavity 15 therebetween. It should be noted that rail body 10.1 is not necessarily limited to having a parallelepiped shape, and therefore, can be provided with any desired shape insofar as functionally compatible with the present invention.

In other exemplary aspects, first flange 16 can be connected to post rail body 10.1, can extend from, and perpendicularly to, right side 13, and can include a first spline groove 16.1; whilst second flange 17 can be connected to post rail body 10.1, can extend from, and perpendicularly to, left side 14, and can include a second spline groove 17.1.

As further illustrated, first and second flanges 16, 17 can be coplanar.

In an exemplary aspect, first flange 16 can include an outer first flange surface 16.2, rear side 13 can include an outer rear side surface 12.1 facing away from front side 11, and the outer first flange surface and the outer rear side surface can form a continuous surface.

In another exemplary aspect, first flange 16 can include an inner first flange surface 16.3 that includes first spline groove 16.1.

In yet another exemplary aspect, first flange 16 can include an outer first flange surface 16.2, second flange 17 can include an outer second flange surface 17.2, rear side 12 can include an outer rear side surface 12.1 facing away from front side 11, and the outer first flange surface, the outer second flange surface, and the outer rear side surface can form a continuous surface.

In still another exemplary aspect, first flange 16 can include an inner first flange surface 16.3 that includes first spline groove 16.1, and second flange 17 can include an inner second flange surface 17.3 that includes second spline groove 17.1.

In another exemplary aspect, one of the right and left sides 13, 14 can be configured to fixably attach to post rail 10. As illustratively shown, right side 13 can be provided with at least one male attachment structure 13.2, and post rail 10 can include one or more corresponding female attachment structures 18 configured to engage a male attachment structure. While male and female attachment structures 13.2, 18 are illustratively shown as having a hook-catch configuration, the present invention contemplates the use of any one or more functionally compatible structures, insofar as functionally compatible with the present invention.

In an additional exemplary aspect, one of the right and left sides 13, 14 can include another inner surface 13.1, 14.1 having at least one screw boss 14.2, which can provide an attachment structure for attachment with another component of a screen frame, a desired accessory, or a portion of a commercial or residential structure (e.g., a wall, pillar, etc.).

In an exemplary aspect, first and second flanges 16, 17 can be integral with rear side 12.

Figure 2:
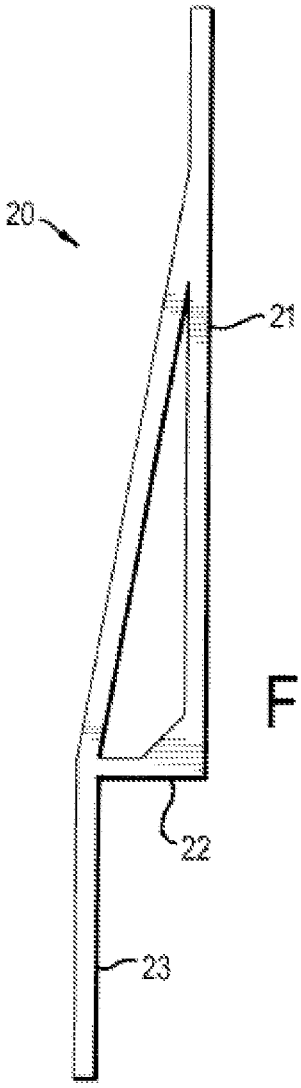
FIG. 2 illustrates a side view of an exemplary rear bracket having rail, floor, and side braces.
Figure 5A:
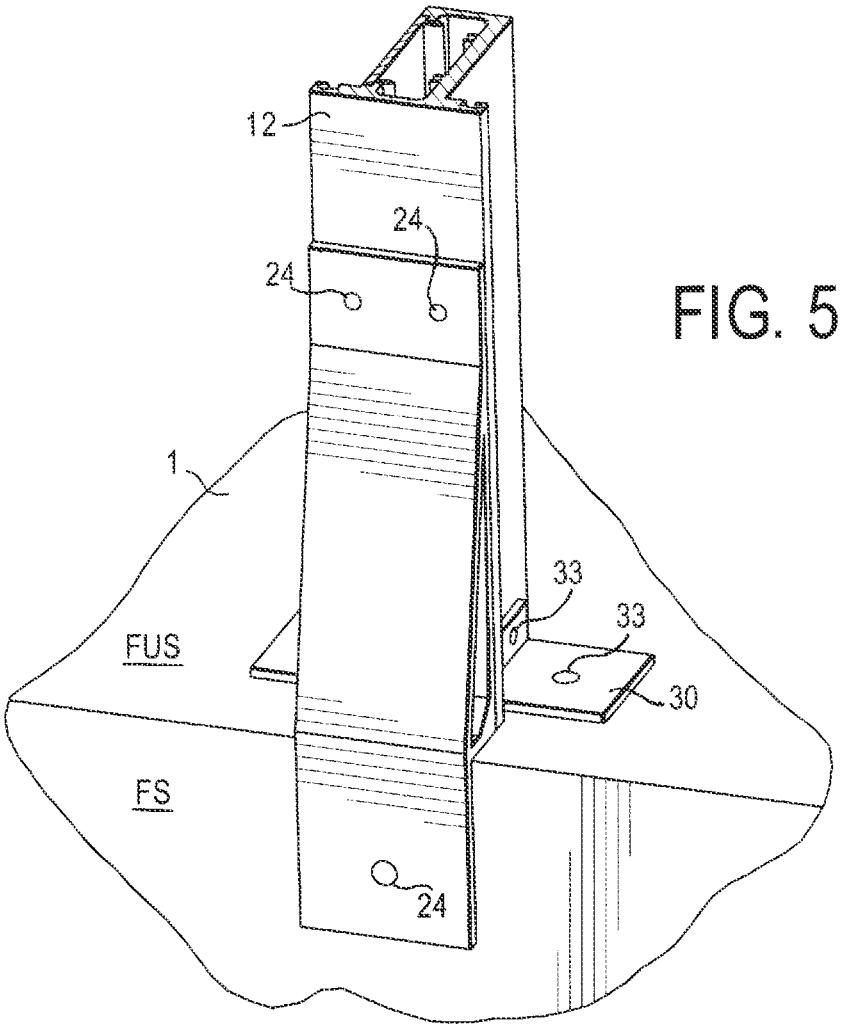
FIG. 5A illustrates a perspective view of an exemplary post rail positioned against a floor and an exemplary rear bracket positioned against the post rail, the floor upper surface, and the floor side.

In another exemplary aspect, a screen enclosure frame can additionally include a rear bracket 20. FIG. 2 illustrates an exemplary rear bracket 20, which can provide structural support to a post rail 10 fixed to a floor 1 (as illustrated in FIG. 5A). According to the present invention, rear bracket 20 can be provided as one or more structural elements and can be formed from any one or more desired materials, insofar as the same provides sufficient rigidity and strength to facilitate structural securing of post rail 10 to floor 1. Further, rear bracket 20 can be provided in any functionally compatible shape desired insofar as the same is functionally compatible with the present invention.

As illustrated in FIG. 2, rear bracket 20 can include a rail brace 21, a floor brace 22, and a side brace 23. As illustratively shown in FIG. 5A, rail brace 21 can be configured to abut and attach to rear side 12, floor brace 22 can be configured to abut a floor upper surface FUS, and side brace 23 can be configured to abut and attach to a floor side FS. As further illustrated, rear bracket 20 can include at least one aperture 24 compatibly positioned to accommodate a screw or other attachment structure for attachment of rear bracket to floor 1 and/or post rail 10. Notably, while rear bracket 20 is illustratively shown as having a "Z" shape, the same can be provided in any functionally compatible shape desired insofar as the same is functionally compatible with the present invention.

Figure 3:
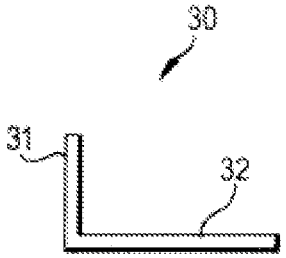
FIG. 3 illustrates a side view of an exemplary side bracket having lateral and surface braces.

In still another exemplary aspect, a screen enclosure frame can additionally include a side bracket 30. FIG. 3 illustrates an exemplary side bracket 30, which can also provide structural support to a post rail fixed to a floor 1. According to the present invention, side bracket 30 can be provided as one or more structural elements and can be formed from any one or more desired materials, insofar as the same provides sufficient rigidity and strength to facilitate structural securing of post rail 10 to floor 1. Notably, while side bracket 30 is illustratively shown as having an "L" shape, the same can be provided in any functionally compatible shape desired insofar as the same is functionally compatible with the present invention.

As illustrated in FIG. 3, side bracket 30 can include a lateral brace 31 and a surface brace 32. As illustratively shown in FIG. 5A, lateral brace 31 can be configured to abut and attach to one of right and left sides 13, 14, and surface brace 32 can be configured to abut and attach to a floor upper side FUS. As further illustrated, side bracket 30 can include at least one aperture 33 compatibly positioned to accommodate a screw or other attachment structure for attachment of the side bracket to floor 1 and/or post rail 10.

Figure 5B:
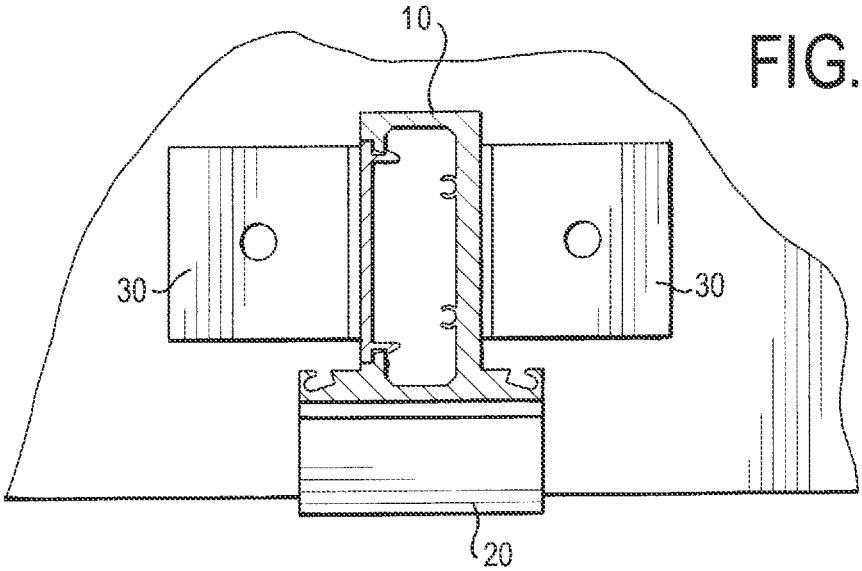
FIG. 5B illustrates a bottom view of an exemplary post rail positioned against a floor and an exemplary rear bracket positioned against the post rail, the floor upper surface, and the floor side.

FIG. 5*b* illustrates a bottom view of an exemplary post rail 10, rear bracket 20, and side brackets 30 in an exemplary configuration.

Figure 4A:
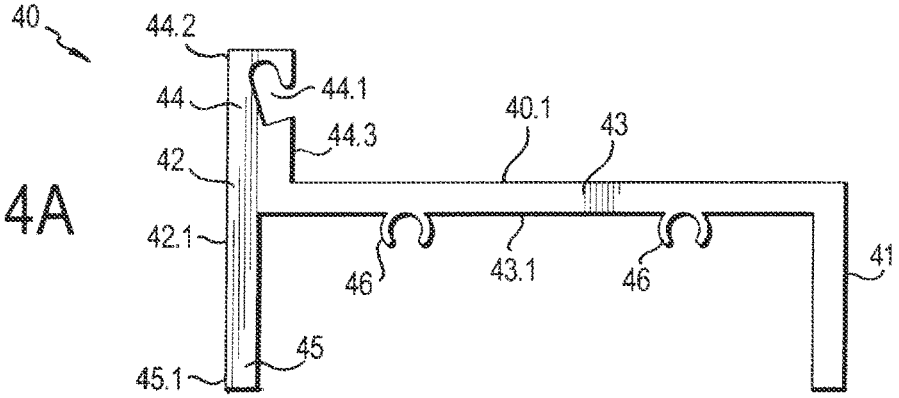
FIG. 4A illustrates a side view of an exemplary track rail having upper and lower flanges and an upper spline groove.
Figure 4B:
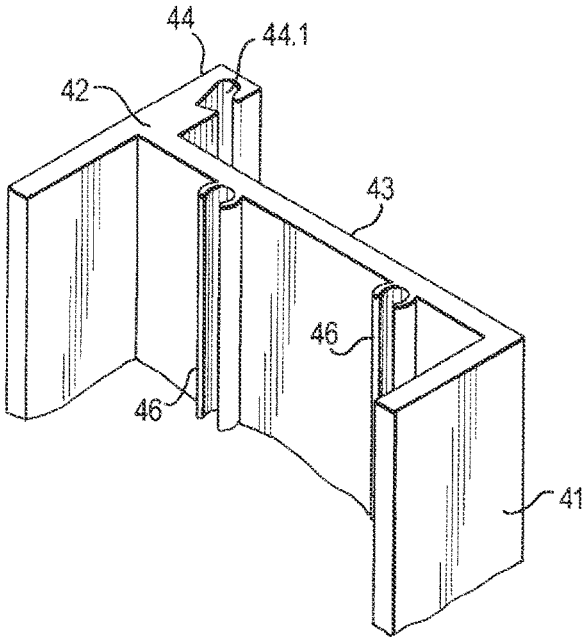
FIG. 4B illustrates a perspective view of an exemplary track rail having upper and lower flanges and an upper spline groove.

In another exemplary aspect, a screen enclosure frame can further include a track rail, which can be attached to a floor or structural frame of a structure via a screw or other desired attachment element. As illustratively shown in FIGS. 4A and 4B, track rail 40 can include a track rail body 40.1, an upper flange 44, and a lower flange 45.

In exemplary aspects, track rail body 40.1 can include proximate, distal, and upper sides 41, 42, 43; upper flange 44 can be connected to the track rail body, extend perpendicularly from the upper side, and can include an upper spline groove 44.1; and lower flange 45 can be connected to the track rail body, and can extend perpendicularly from the upper side.

In another exemplary aspect, upper and lower flanges 44, 45 can be coplanar.

In further exemplary aspects, upper flange 44 can include an outer upper flange surface 44.2, distal side 42 can include an outer distal side surface 42.1 facing away from proximate side 41, and the outer upper flange surface and the outer distal side surface can form a continuous surface.

In still another exemplary aspect, upper flange 44 can include an inner upper flange surface 44.3 that can include upper spline groove 44.1.

In still further exemplary aspects, upper flange 44 can include outer upper flange surface 44.2, lower flange 45 can include an outer lower flange surface 45.1, distal side 42 can include outer distal side surface 42.1 facing away from proximate side 41, and the outer upper flange surface, the outer lower flange surface, and the outer distal side surface can form a continuous surface.

In yet another exemplary aspect, upper and lower flanges 44, 45 can be integral with distal side 42.

In still another exemplary aspect, upper side 43 can include an inner upper side surface 43.1 having at least one screw boss 46.

It should be noted that in an exemplary aspect of the present invention, when one or more of post rail 10 and track rail 40 are positioned, their respective spline grooves 16.1, 17.1, 44.1 can face inwardly, such that a screen can be applied or replaced from within a screened area, which can be highly desirable.

It should also be noted that one or more of post rail 10 and track rail 40 can be particularly formed at the time of manufacturing to omit a portion thereof, or trimmed during installation, so as to complementarily fit an adjacent post rail or track rail. Such forming or trimming can provide a more visually pleasing product and/or can align or join respective spline grooves.

It should be further noted that post rail 10 can be positioned in a vertical orientation, so as to function as a post; or in a horizontal orientation, so as to act as a chair rail.

Figure 6A:
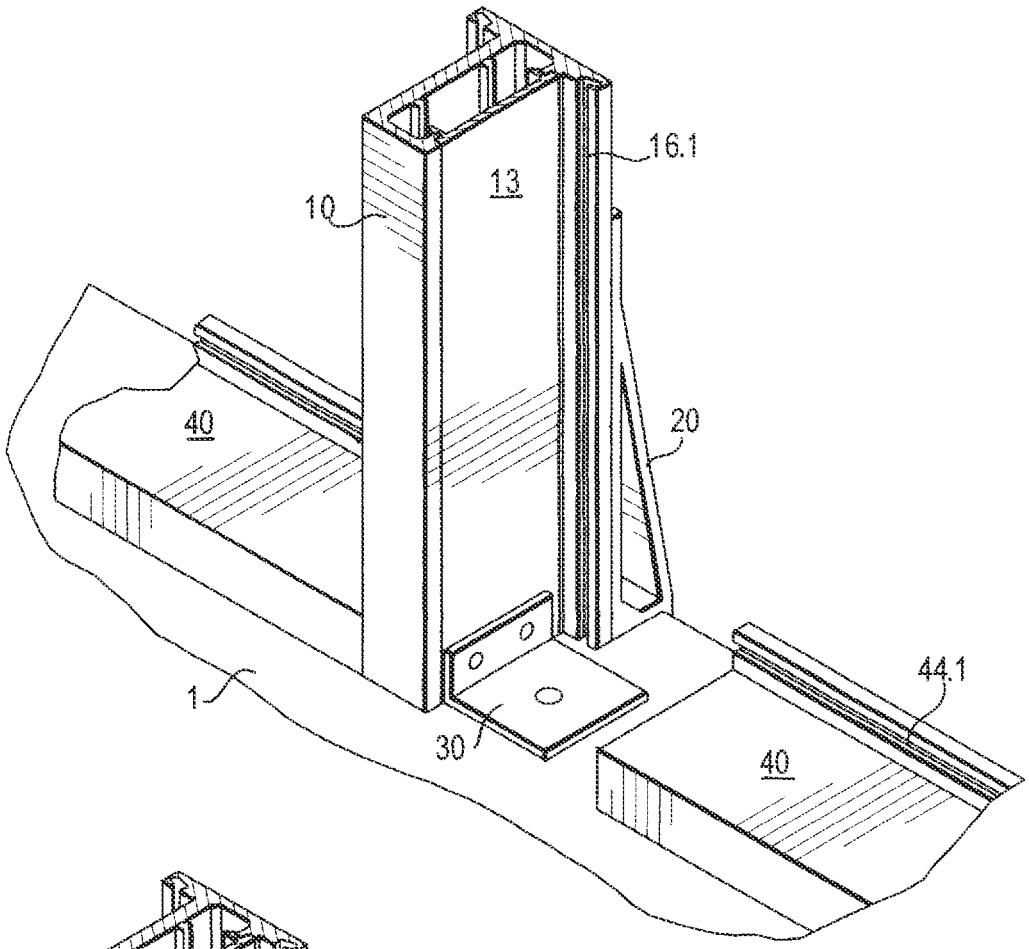
FIG. 6A illustrates a perspective view of an exemplary arrangement of a post rail, rear and side brackets, and track rails prior to positioning of one of the trail rails against the post rail.
Figure 6B:
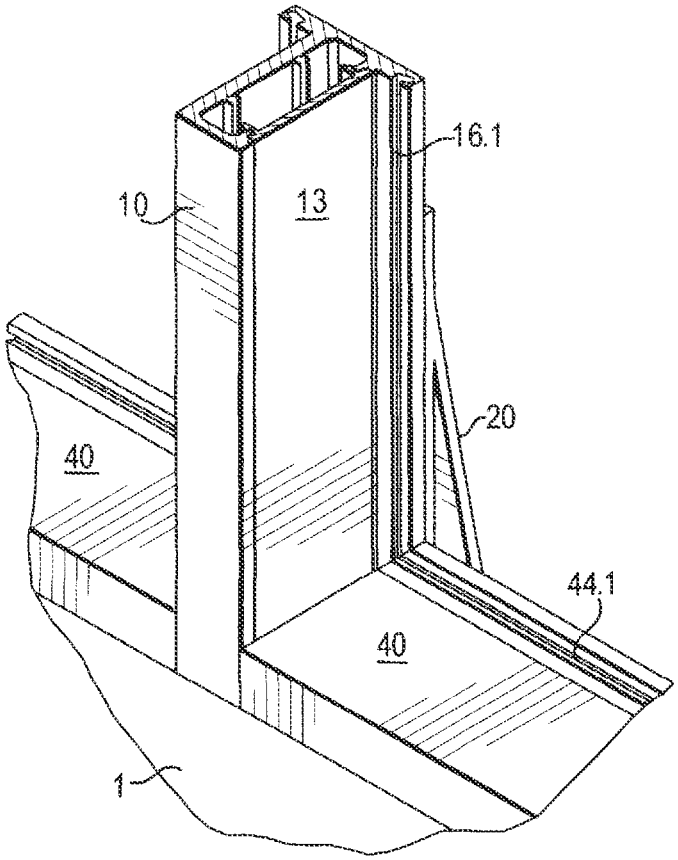
FIG. 6B illustrates a perspective view of an exemplary arrangement of a post rail, rear and side brackets, and track rails positioned against the post rail.

FIGS. 6A and 6B illustrate an exemplary post rail 10 and track rail 40 configuration according to an exemplary application of the present invention. FIG. 6A is an exploded view in which post rail 10 is in a vertical orientation and positioned against floor 1, with rear and side brackets 20, 30 facilitating a secure fixation of the post rail to the floor. As illustrated, in an exemplary application, side bracket 30 can be positioned against and fixed to post rail 10 and floor 1. And as illustrated in FIG. 6B, a track rail 40 can be positioned against floor 1 and right side 13. In an exemplary aspect, such a track rail 40 can cover side bracket 30 to provide a desirable finished look.

Figure 7A:
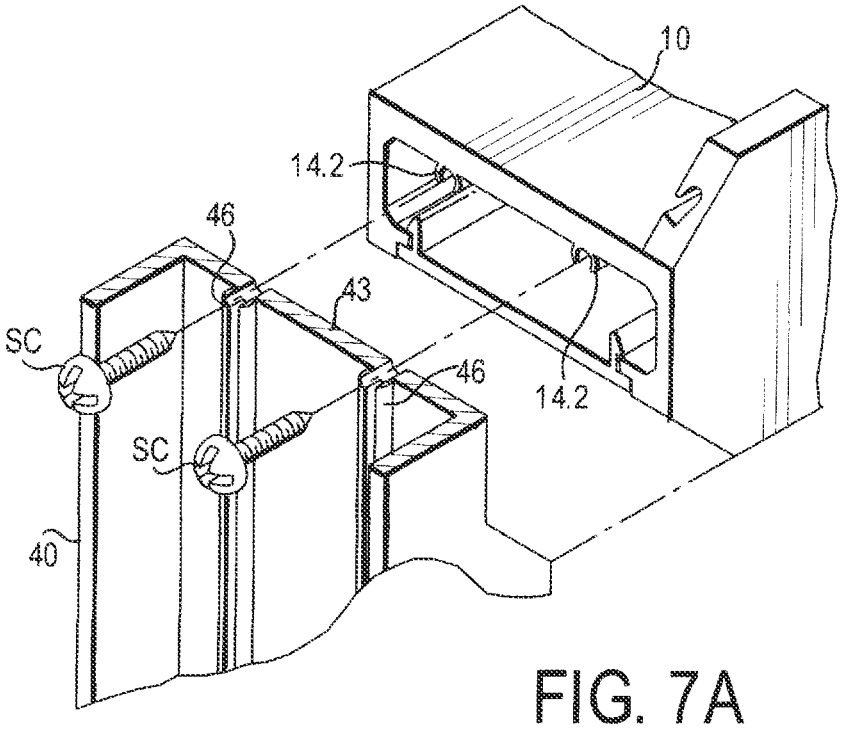
FIG. 7A illustrates an exploded perspective view of an exemplary fixing of a track rail to a post rail.
Figure 7B:
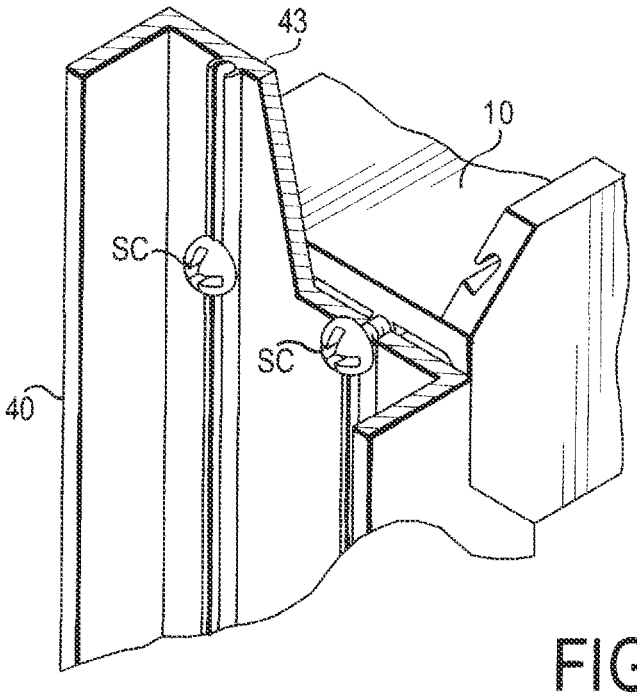
FIG. 7B illustrates a perspective view of an exemplary fixing of a trail rail to a post rail.

FIGS. 7A and 7B illustrate an exemplary fixing of an exemplary post rail 10 to an exemplary track rail 40. As illustratively shown, one or more screws SC can pass through upper side 43 of track rail 40 and into screw boss 14.2 of post rail 10. Notably, screws SC can be passed through any portion of track rail 40 insofar as desired, as plural configurations are contemplated.

Figure 8A:
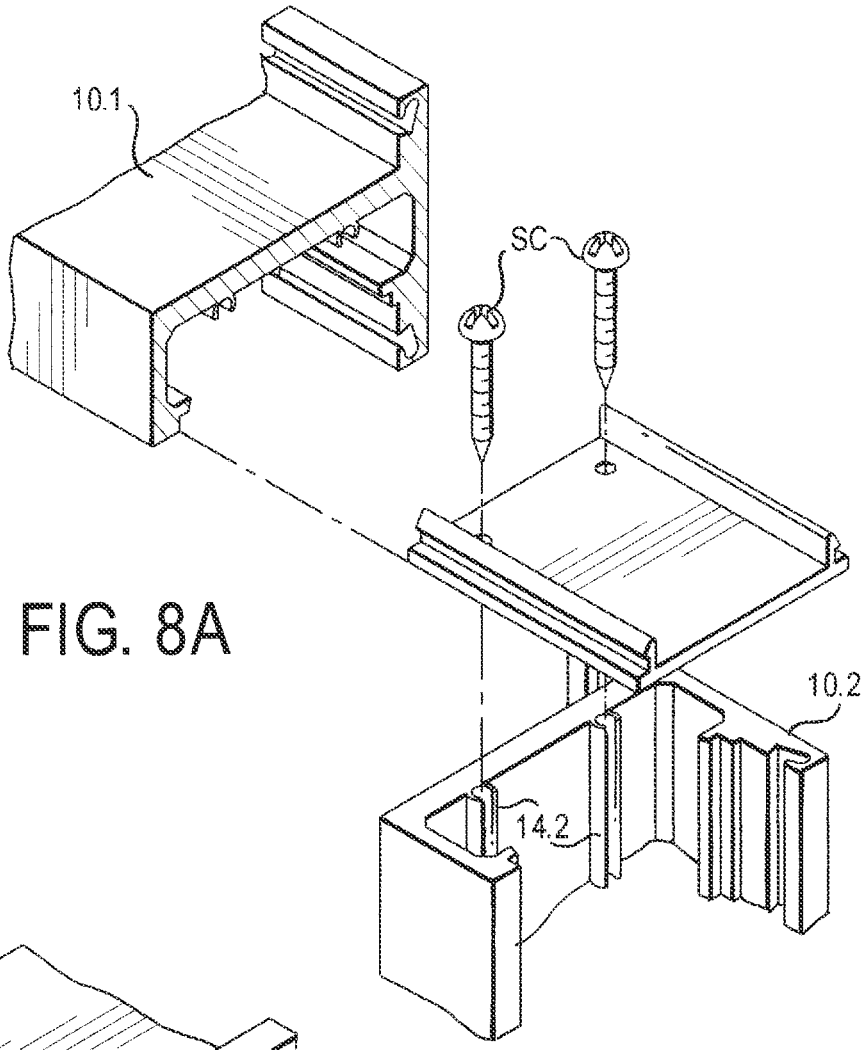
FIG. 8A illustrates an exploded perspective view of an exemplary fixation of a vertically-oriented post rail fixed to a horizontally-oriented post rail.
Figure 8B:
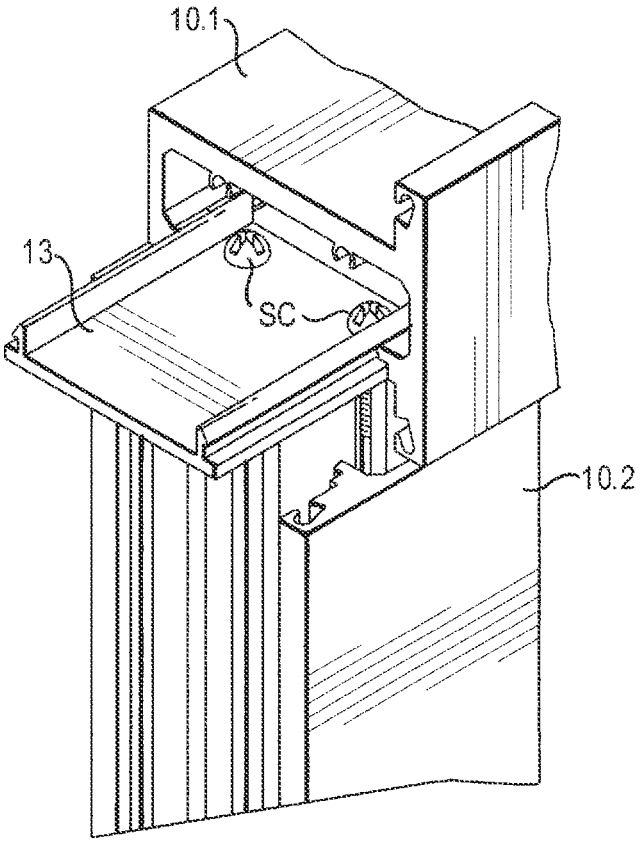
FIG. 8B illustrates a perspective view of a vertical-oriented post rail fixed to a horizontally-oriented post rail.

FIGS. 8A and 8B illustrate an exemplary fixation of a horizontally-oriented post rail 10.1 to a vertically-oriented post rail 10.2, which can illustrate an exemplary post rail-chair rail junction. As illustratively shown, one or more screws SC can be passed through right side 13 of post rail 10.1 and into screw bosses 14.2 of post rail 10.2. Notably, right side 13 can be fixed to post rail 10.2 initially, with post rail 10.1 then being snapped around the right side or slid there around, which can engage post rail 10.1 to post rail 10.2.

FIG. 9A illustrates an exemplary post rail 10 having a spindle assembly 50 attached thereto; whilst FIG. 9B illustrates an exemplary track rail 40 having a spindle assembly 50 attached thereto.

In an exemplary aspect, a spindle assembly 50 can include a spindle 51 and a connector 52. As illustratively shown, spindle 51 can be provided as a cable, which can be formed from stainless steel. In another exemplary aspect, connector 52 can be provided as any one or more structural components configured to attach spindle 51 to post rail 10 or to track rail 40 insofar as the same is functionally compatible. As illustratively shown, connector 51 can include a rivet nut RN engaged with left side 14 of post rail 10 (and with upper side 43 of track rail 40), and a shaft SH engagable with the rivet nut and a cylinder C, which can attachably engage to spindle 51.

FIG. 10 illustrates plural exemplary post rails 10, track rails 40, and spindle assemblies 50 configured to form an exemplary screen enclosure frame. As illustratively shown, track rails 40 can define an outer boundary within which a horizontally-oriented post rail 10.1 can be provided as a chair rail, and plural vertically-oriented post rails 10.2 can be provided as posts.

It will be apparent to one of ordinary skill in the art that the manner of making and using the claimed invention has been adequately disclosed in the above-written description of the exemplary embodiments and aspects.

It should be understood, however, that the invention is not necessarily limited to the specific embodiments, aspects, arrangement, and components shown and described above, but may be susceptible to numerous variations within the scope of the invention.

Therefore, the specification and drawings are to be regarded in an illustrative and enabling, rather than a restrictive, sense.

Accordingly, it will be understood that the above description of the embodiments of the present invention are susceptible to various modifications, changes, and adaptations, and the same are intended to be comprehended within the meaning and range of equivalents of the appended claims.

Therefore, I claim:

1. A screen enclosure frame, comprising:

a post rail, said post rail comprising a post rail body having front, rear, right, and left sides defining a post rail cavity therebetween, a first flange, connected to the post rail body, and extending from, and perpendicularly to, the right side, the first flange completely having a first spline groove therein; and a second flange, connected to the post rail body, and extending from, and perpendicularly to, the left side, the second flange completely having a second spline groove therein;

wherein the first flange includes an outer first flange surface facing away from the front side, the rear side includes an outer rear side surface facing away from the front side, the outer first flange surface and the outer rear side surface are coplanar, the first flange includes an inner first flange surface that includes the first spline groove, and the first and second flanges are coplanar.

2. The frame of claim 1, wherein the first flange includes an outer first flange surface, the second flange includes an outer second flange surface, the rear side includes an outer rear side surface facing away from the front side, and the outer first flange surface, the outer second flange surface, and the outer rear side surface form a continuous surface.

3. The frame of claim 2, wherein the first flange includes an inner first flange surface that includes the first spline groove, and the second flange includes an inner second flange surface that includes the second spline groove.

4. The frame of claim 1, wherein one of the right and left sides fixably attaches to the post rail.

5. The frame of claim 4, wherein the one of the right and left sides includes an inner surface having one of a male and a female attachment structure, and the post rail includes the other of a male and female attachment structure configured to engage the one of a male and a female attachment structure.

6. The frame of claim 4, wherein the other of the right and left sides includes another inner surface having at least one screw boss.

7. The frame of claim 1, wherein one of the right and left sides includes an inner surface having at least one screw boss.

8. The frame of claim 1, wherein the first and second flanges are integral with the rear side.

9. The frame of claim 1, further comprising a rear bracket, said rear bracket comprising a rail brace configured to abut and attach to the rear side, a floor brace configured to abut a floor upper surface, and a side brace configured to abut and attach to a floor side.

10. The frame of claim 9, further comprising a side bracket, said side bracket comprising a lateral brace configured to abut and attach to one of the right and left sides, and a surface brace configured to abut and attach to the floor upper surface.

11. The frame of claim 1, further comprising a side bracket, said side bracket comprising a lateral brace configured to abut and attach to one of the right and left sides, and a surface brace configured to abut and attach to a floor upper surface.

12. The frame of claim 1, further comprising a track rail, said track rail comprising a track rail body having proximate, distal, and upper sides;

an upper flange, connected to the track rail body, and extending perpendicularly from the upper side, the upper flange having an upper spline groove; and a lower flange, connected to the track rail body, and extending perpendicularly from the upper side;

wherein the upper and lower flanges are coplanar.

13. The frame of claim 12, wherein the upper flange includes an outer upper flange surface, the distal side of the track rail body includes an outer distal side surface facing away from the proximate side of the track rail body, and the outer upper flange surface and the outer distal side surface form a continuous surface.

14. The frame of claim 13, wherein the upper flange includes an inner upper flange surface that includes the upper spline groove.

15. The frame of claim 12, wherein the upper flange includes an outer upper flange surface, the lower flange includes an outer lower flange surface, the distal side of the track rail body includes an outer distal side surface facing away from the proximate side of the track rail body, and the outer upper flange surface, the outer lower flange surface, and the outer distal side surface are coplanar.

16. The frame of claim 12, wherein the upper and lower flanges are integral with the distal side of the track rail body.

17. A screen enclosure frame, comprising:

a rear bracket, said rear bracket comprising a rail brace configured to abut and attach to the rear side, a floor brace configured to abut a floor upper surface, and a side brace configured to abut and attach to a floor side; and a post rail, said post rail comprising a post rail body having a front, rear, right, and left sides defining a post rail cavity therebetween, a first flange, connected to the post rail body, and extending from, and perpendicularly to, the right side, the first flange having a first spline groove; and a second flange, connected to the post rail body, and extending from, and perpendicularly to, the left side, the second flange having a second spline groove;

wherein the first and second flanges are coplanar.

18. The frame of claim 17, further comprising a side bracket, said side bracket comprising a lateral brace configured to abut and attach to one of the right and left sides, and a surface brace configured to abut and attach to the floor upper surface.

* * * * *